United States Patent [19]

Pask et al.

[11] Patent Number: 4,484,859

[45] Date of Patent: Nov. 27, 1984

[54] ROTOR BLADE FOR A GAS TURBINE ENGINE

[75] Inventors: George Pask, Stanton-by-Bridge; John H. R. Sadler, Aston-on-Trent; John F. Coplin, Duffield, all of England

[73] Assignee: Rolls-Royce Limited, London, England

[21] Appl. No.: 449,530

[22] Filed: Dec. 13, 1982

Related U.S. Application Data

[63] Continuation of Ser. No. 218,453, Dec. 19, 1980, abandoned.

[30] Foreign Application Priority Data

Jan. 17, 1980 [GB] United Kingdom ..... 8001657

[51] Int. Cl.[3] ..... F01D 5/18

[52] U.S. Cl. ..... 416/96 A; 415/115; 416/145; 416/500; 416/97 R

[58] Field of Search ..... 416/95–97 A, 416/145, 241 B, 500; 415/115

[56] References Cited

U.S. PATENT DOCUMENTS

| | | | |
|---|---|---|---|
| 2,144,428 | 1/1939 | Martin . | |
| 2,999,669 | 9/1961 | McGinnis . | |
| 3,628,885 | 12/1971 | Sidenstick et al. | 416/96 A |
| 3,715,170 | 2/1973 | Savage et al. . | |
| 3,752,599 | 8/1973 | Pace . | |
| 3,867,068 | 2/1975 | Corsmeier et al. . | |
| 3,881,844 | 5/1975 | Hennessey et al. | 416/145 |
| 3,905,723 | 9/1975 | Torti, Jr. . | |
| 3,966,357 | 6/1976 | Corsmeier . | |
| 4,101,245 | 7/1978 | Hess et al. . | |
| 4,171,184 | 10/1979 | Lings et al. . | |
| 4,355,957 | 10/1982 | Sifford et al. | 416/145 |

FOREIGN PATENT DOCUMENTS

| | | |
|---|---|---|
| 981599 | 5/1951 | France . |
| 1007303 | 5/1952 | France . |

*Primary Examiner*—Samuel Scott
*Assistant Examiner*—Brian J. Bowman
*Attorney, Agent, or Firm*—Cushman, Darby & Cushman

[57] ABSTRACT

In order to damp possible vibration of a rotor blade for a gas turbine engine, the blade has a hollow tip portion with an internal surface extending across the direction of the centrifugal field on the blade. A weight comprising e.g. Silicon Nitride or Carbide is caused by centrifugal force to bear on this surface. Relative motion and hence friction between the weight and the surface serves to damp vibration of the blade.

6 Claims, 5 Drawing Figures

ROTOR BLADE FOR A GAS TURBINE ENGINE

This is a continuation of application Ser. No. 218,453, filed Dec. 19, 1980, now abandoned.

This invention relates to a rotor blade for a gas turbine engine.

One problem arising with such rotor blades, particularly when they are not connected together by tip shrouds, lies in the vibration of the aerofoil part of the blades. In the past this problem has been approached by the provision of damper weights under the blade platforms, which has been successful in damping vibration but has necessitated other undesirable features. Thus in order to provide sufficient damping it is necessary to provide a relatively long shank to the blade which extends between the root and the platform, and the platforms themselves need to be heavier in order to carry the relatively large loads produced in a centrifugal field even by the very small damper weights used.

The present invention provides a rotor blade having internal damping at its tip, which is the most effective position for such damping.

According to the present invention, a rotor blade for a gas turbine engine comprises an aerofoil having a hollow portion at its tip and an internal surface of said hollow portion extending across the direction of centrifugal force acting on the blade in operation, and a weight carried adjacent said face and free to bear on the face under the action of centrifugal force so that should the blade vibrate, sliding movement may take place between the weight and the surface whereby the vibration of the blade is damped.

The weight is preferably of ceramic material.

In a preferred embodiment the rotor blade has a hollow aerofoil and the weight is held in place by the tip portion of a cooling air entry tube located within the hollow aerofoil.

Various ceramic materials, such for instance as Silicon Nitride, or Silicon Carbide may be used to form the weight.

Figure 1:
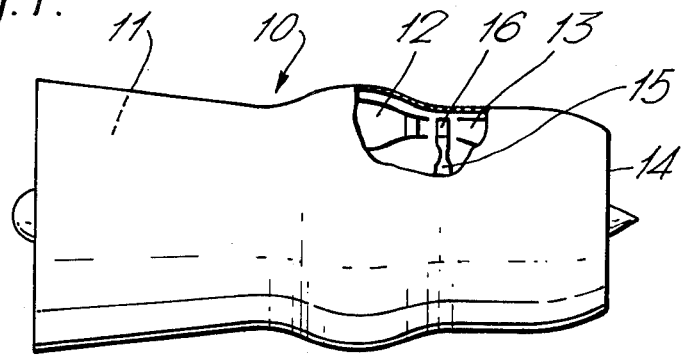
Figure 2:
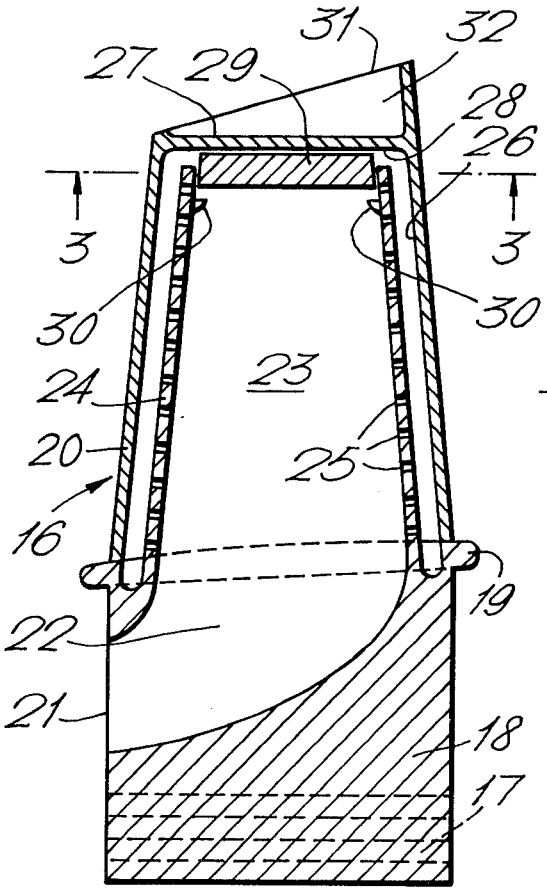
Figure 3:
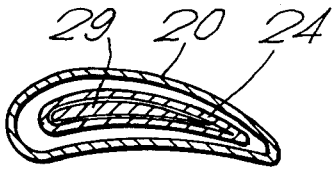
Figure 4:
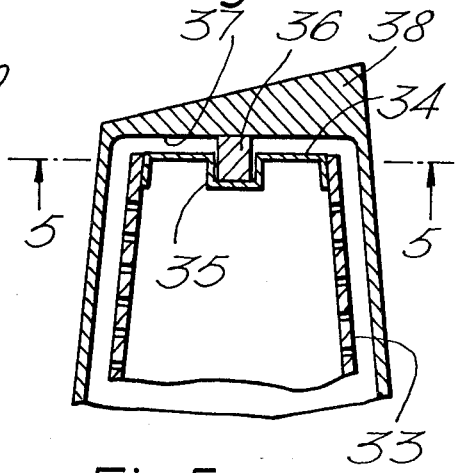
Figure 5:
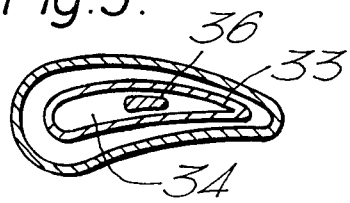

The invention will now be particularly described, merely by way of example, with reference to the accompanying drawings in which:

FIG. 1 is a partly broken-away drawing of a gas turbine engine having turbine rotor blades in accordance with the invention, FIG. 2 is an enlarged section through one of the rotor blades of FIG. 1, FIG. 3 is a section on the line 3—3 of FIG. 2, FIG. 4 is the tip part of a section through a second embodiment of rotor blade in accordance with the invention, and FIG. 5 is a section on the line 5—5 of FIG. 4.

In FIG. 1 there is shown a gas turbine engine 10 including the conventional components of compressor 11, combustion section 12, turbine 13 and final nozzle 14. Operation of the engine overall is conventional and is not further described in this specification. It should be remarked that the engine illustrated represents a very simple case, which could be considered as the core engine of a fan or other more complex engine. The present invention is applicable to various different kinds of gas turbine engines.

The turbine section 13 of the engine comprises a rotor disc 15 which carries a plurality of rotor blades 16. The blades 16 are acted on by the hot gas exhausting from the combustion section 12 and drive the rotor disc 15 and hence the compressor 11. FIG. 2 shows in enlarged cross section one of the blades 16 which will be seen to comprise a serrated root 17, a shank 18, a platform 19 and a hollow aerofoil 20. It will be seen that in this case there is no tip shroud attached to the aerofoil as is used in some turbines.

Because of the hot environment in which the blade, and in particular the aerofoil operates, it is necessary to make provision for cooling the aerofoil. The shank 18 is therefore provided with a cooling air entry aperture 21 through which cooling air from a source (not shown) flows into a passage 22 leading into the hollow interior 23 of a cooling air entry tube 24. The tube 24 is illustrated as being an integral part of the blade, but it will be appreciated that it could easily comprise a piece fabricated separately and brazed or otherwise attached to the hollow blade interior at the shank end of the aerofoil.

However it is made, the tube 24 is provided with a plurality of impingement cooling apertures 25 through which the cooling air flows in a plurality of jets to impinge on the inner surface 26 of the hollow aerofoil 20. In order to facilitate this process the tube 24 is arranged to conform to the shape of the inner surface 26 so as to leave only a small gap across which the jets of cooling air must pass to impinge on the inner surface 26.

As so far described the blade is conventional, and it will be appreciated by those skilled in the art that this cooling system using a single air entry tube which impingement cools the whole aerofoil is a rather simple form of cooling. In practice one may well want to use a more complex system involving passages cast within the blade as well as the entry tube and impingement system described.

Because the blade 16 does not have a tip shroud to restrain its vibrational movement it will be prone to considerable vibration at certain resonant frequencies. In order to provide damping of vibration such as this, the hollow aerofoil is provided with a tip partition 27 having an inner surface 28 which extends across the direction of the centrifugal field acting on the blade in operation. In fact, in the illustrated embodiment the surface 28 is perpendicular to this direction. A weight 29, which in the present instance is a ceramic such as Silicon Nitride or Silicon Carbide, retained in the open tip of the tube 24 is free to move radially outwards under centrifugal force, but is retained by its engagement with the inside of the tube 24. A series of projections 30 from the inside of the tube 24 prevent the weight 29 from falling down into the interior of the tube, and as can be seen from FIG. 3, the weight fits quite closely within the tube 24 to provide a seal for the otherwise open tube end.

It will be appreciated that when the engine is operating, the rotor 15 and blades 16 will rotate at high speed and the weights 29 will be forced against the inner surface 28 of the partition 26. Should the blade vibrate, the different dimensions of the aerofoil 20 and the tube 24 will cause their motions to be different, and consequently the tip of the tube 24 will move relative to the tip of the aerofoil 20, causing the weight 29 to be translated along the surface 28. The frictional engagement between the surface and the weight will resist this movement, and in overcoming this resistance energy will be spent and hence the vibration will be damped.

Clearly if the frictional force resisting motion of the weight on the surface 28 is too great, there will be no such motion and the system will 'lock-up' and provide little or no damping. The frictional force depends upon the mass of the weight and the coefficient of friction between the material of the weight and surface. We find that for a practical blade the mass of the weight and the coefficient must be low, and this combination is capable of being achieved by the ceramic weight referred to. For ceramics the coefficient of friction may be less than half that of a superalloy material while the density is some ⅓ that of the superalloy.

One further point which should be noted in relation to the FIGS. 2 and 3 embodiment concerns the orientation of the partition 27. It is necessary that the surface 28 should lie across the direction of the centrifugal field on the aerofoil so that there is a minimum sideways force on the weight 29 which will tend to force the weight against one wall of the tube 24 and hence to 'lock-up' the system. However, the tip 31 of the blade need not lie parallel to the partition 27, and this tip is in fact shown as having a considerable degree of 'hade'. In order to reconcile these requirements the tip of the aerofoil has a hollow space 32 outboard of the partition 26.

Turning now to FIGS. 4 and 5, the basic blade and its cooling arrangement is similar to that of the FIGS. 2 and 3 embodiment. In this case, however, the tip of the tube 33 is closed off by a plug 34 which is brazed to the interior of the tube. The plug 34 has a well 35 formed in its outwardly facing surface, and in this well a ceramic weight 36, again of Silicon Nitride or Silicon Carbide is located. The weight 36 is again free to move to engage with a surface 37 which is the internal surface of a plug 38 which forms the tip of the blade aerofoil. As in the case of the surface 28 of the first embodiment, the surface 37 is arranged across, in this case perpendicular to the direction of the centrifugal field, and the damping effect of the weight 36 is produced in exactly the same way as in the previous embodiment.

It will be noted that in the FIG. 4 arrangement the tip of the blade again exhibits 'hade' i.e. it is not parallel with the surface 37. In this case the area between the tip and the surface 37 is completely filled in by the plug 38. It will also be seen that this embodiment provides a better seal for the tip of the air entry tube than does the previous embodiment, but at the expense of a slightly heavier and more complex structure.

It will be understood that there are a number of modifications which could be made to the embodiments described above. Thus as mentioned above, the cooling air system described is very simple and could well be replaced by a more complex arrangement. Also the weight, although conveniently located by the tip of the air entry tube, need not be so located, and of course it is possible to use the weights without any tube or similar structure to locate them. One skilled in the art will appreciate that there are various materials and in particular ceramic materials which may be used to form the weight.

It will also be appreciated that the invention could be applied to an uncooled blade which is solid except for a hollow especially formed at the tip to accommodate the damper in accordance with the invention.

We claim:

1. A blade for a rotor of a gas turbine engine, said blade having a longitudinal axis and being subjected to a centrifugal force in a direction along said longitudinal axis when rotating, said blade comprising:

a hollow aerofoil portion having a closed blade tip at one end and a shank portion at the other end, said closed blade tip having an internal surface extending across the direction of centrifugal force experienced by the blade during operation;

a cooling air entry tube positioned within said hollow aerofoil portion of said blade and extending longitudinally thereof in spaced relationship therewith from said shank portion toward said blade tip and terminating in a tube tip short of said internal surface of said blade tip; and a weight comprising a ceramic material having a low mass and a low coefficient of friction for providing damping without said tip of said hollow aerofoil portion being locked to said cooling air entry tube, said weight being supported in place by said tube tip adjacent to but short of said internal surface when said blade is stationary, said weight being free to bear against said internal surface of said blade tip under action of centrifugal force so that when said aerofoil portion of said blade and said air entry tube vibrate relative to each other, sliding frictional movement takes place between said weight and said internal surface of said blade tip to simultaneously provide damping of vibration of both said aerofoil portion of said blade and said air entry tube.

2. A rotor blade as claimed in claim 1 and in which said weight comprises Silicon Nitride.

3. A rotor blade as claimed in claim 1 and in which said weight comprises Silicon Carbide.

4. A rotor blade as claimed in claim 1 in which said internal surface of said blade tip extends perpendicular to said direction of said centrifugal force.

5. A blade for a rotor of a gas turbine engine, said blade having a longitudinal axis and being subjected to a centrifugal force in a direction along said longitudinal axis when rotating, said blade comprising:

a hollow aerofoil portion having a closed blade tip at one end and a shank portion at the other end, said closed blade tip having an internal surface extending across the the direction of centrifugal force experienced by the blade during operation;

a cooling air entry tube positioned within said hollow aerofoil portion of said blade and extending longitudinally thereof in spaced relationship therewith from said shank portion toward said blade tip and terminating in a tube tip short of said internal surface of said blade tip, said tube tip having an open end; and a weight comprising a ceramic material having a low mass and a low coefficient of friction for providing damping without said tip of said hollow aerofoil portion being locked to said cooling air entry tube due to centrifugal force acting on said weight during rotation of said blade, said weight being sealingly seated in said open end of said tube tip adjacent to said internal surface, said weight being free to bear against said internal surface of said blade tip under action of centrifugal force so that when said aerofoil portion of said blade and said air entry tube vibrate relative to each other, sliding frictional movement takes place between said weight and said internal surface of said blade tip to simultaneously provide damping of vibration of both said aerofoil portion of said blade and said air entry tube.

6. A blade for a rotor of a gas turbine engine, said blade having a longitudinal axis and being subjected to a centrifugal force in a direction along said longitudinal axis when rotating, said blade comprising:

a hollow aerofoil portion having a closed blade tip at one end and a shank portion at the other end, said closed blade tip having an internal surface extending across the direction of centrifugal force experienced by the blade during operation;

a cooling air entry tube positioned within said hollow aerofoil portion of said blade and extending longitudinally thereof in spaced relationship therewith from said shank portion toward said blade tip and terminating in a tube tip short of said internal surface of said blade tip, said tube tip having an open end, a plug member obturating and sealing said open end of said tube tip, said plug member having a well therein facing said internal surface of said blade tip; and a weight comprising a ceramic material having a low mass and a low coefficient of friction for providing damping without said tip of said hollow aerofoil portion being locked to said cooling air entry tube due to centrifugal force acting on said weight during rotation of said blade, said weight being carried in said well and free to bear against said internal surface of said blade tip under action of said centrifugal force so that when said aerofoil portion of said blade and said air entry tube vibrate relative to each other, sliding frictional movement takes place between said weight and said internal surface of said blade tip to simultaneously provide damping of vibration of both said aerofoil portion of said blade and said air entry tube.

* * * * *